US006632299B1

(12) United States Patent
Harris

(10) Patent No.: US 6,632,299 B1
(45) Date of Patent: Oct. 14, 2003

(54) NICKEL-BASE SUPERALLOY FOR HIGH TEMPERATURE, HIGH STRAIN APPLICATION

(75) Inventor: Kenneth Harris, Spring Lake, MI (US)

(73) Assignee: Cannon-Muskegon Corporation, Muskegon, MI (US)

( * ) Notice: Subject to any disclaimer, the term of this patent is extended or adjusted under 35 U.S.C. 154(b) by 30 days.

(21) Appl. No.: 09/692,750

(22) Filed: Oct. 19, 2000

Related U.S. Application Data

(60) Provisional application No. 60/232,822, filed on Sep. 15, 2000.

(51) Int. Cl.[7] ..... C22C 19/05

(52) U.S. Cl. ..... 148/428; 148/404; 148/409; 148/410; 420/448

(58) Field of Search ..... 148/404, 409, 148/410, 428; 420/448

(56) References Cited

U.S. PATENT DOCUMENTS

| | | | |
|---|---|---|---|
| 2,051,562 | A | 8/1936 | Lohr |
| 2,155,047 | A | 4/1939 | Grossman |
| 2,238,160 | A | 4/1941 | Doom |
| 3,164,465 | A | 1/1965 | Thielemann |
| 3,310,399 | A | 3/1967 | Baldwin |
| 3,526,499 | A | 9/1970 | Quigg et al. |
| 3,649,257 | A | 3/1972 | Fletcher |
| 3,890,816 | A | 6/1975 | Allen et al. |
| 3,904,402 | A | 9/1975 | Smashey |
| RE28,681 | E | 1/1976 | Baldwin |
| 4,013,424 | A | 3/1977 | Wildgoose et al. |
| 4,078,951 | A | 3/1978 | Demzine et al. |
| RE29,920 | E | 2/1979 | Baldwin |
| 4,169,742 | A | 10/1979 | Wukusick et al. |
| 4,174,964 | A | 11/1979 | Shaw et al. |

(List continued on next page.)

OTHER PUBLICATIONS

"Effect of Metallurgical Cleanliness of Alloy on Casting Quality"; Quigg, Dr. R.J., Presented at Conference "China's Foundry Industry Tomorrow–Market and Cooperation", Beijing, China, Nov. 2–5, 1993; pp. 1–8.

"Electron Beam Melting and Refining, 1990"; Erickson, G.L.; Cannon–Muskegon Corporation, The Cannon–Muskegon Perspective; 2 pages.

"Extensive Industrial Gas Turbine Experience with Second Generation Single Crystal Alloy Turbine Blades"; Brentnall, W.D., Aurrecoechea, J.M., Rimlinger, C.M., Harris, K., Erickson, G.L., Wahl, J.B.; Presented at International Gas Turbine & Aeroengine Congress & Exhibition, Orlando, Florida, Jun. 2–Jun. 5, 1997, pp. 1–7.

"Improved Performance CMSX–4® Alloy Turbine Blades Utilising PPM Levels of Lanthanum and Yttrium"; Ford, D.A., Bhangu, H.K., Fullagar, K.P.L., Thomas, M.C., Korinko, P.S., Burkholder, P.S., Harris, K., Wahl, J.B.; Presented at the 6th Liège Conference, Materials for Advanced Power Engineering; Liège , Belgium, Oct. 5–7, 1998, 14 pages.

(List continued on next page.)

*Primary Examiner*—Sikyin Ip

(57) ABSTRACT

A nickel-base superalloy that exhibits outstanding mechanical properties under high temperature and high strain conditions when cast in an equiaxed and/or directionally solidified, columnar grain structure, and which exhibits increased grain boundary strength and ductility while maintaining microstructural stability includes, in percentages by weight, 5–6 chromium, 9–9.5 cobalt, 0.3–0.7 molybdenum, 8–9 tungsten, 5.9–6.3 tantalum, 0.05–0.25 titanium, 5.6–6.0 aluminum, 2.8–3.1 rhenium, 1.1–1.8 hafnium, 0.10–0.12 carbon, 0.010–0.024 boron, 0.011–0.020 zirconium, with the balance being nickel and incidental impurities. The superalloys of this invention are useful for casting gas turbine engine components exhibiting significantly improved low cycle fatigue life, improved airfoil high temperature stress rupture life, significantly reduced life cycle cost, and longer useful life.

20 Claims, 3 Drawing Sheets

HIP = HEAT TREATMENT OPTIMIZATION RESULTS.
[SPECIMENS TAKEN FROM THE DISC PORTION OF THE WHEEL.]

U.S. PATENT DOCUMENTS

| | | | | |
|---|---|---|---|---|
| 4,219,592 | A | 8/1980 | Anderson et al. | |
| 4,240,495 | A | * 12/1980 | Vonnegut | 164/125 |
| 4,284,430 | A | 8/1981 | Henry | |
| 4,292,076 | A | 9/1981 | Gigliotti et al. | |
| 4,400,209 | A | 8/1983 | Kudo et al. | |
| 4,400,210 | A | 8/1983 | Kudo et al. | |
| 4,589,937 | A | * 5/1986 | Jackson et al. | 148/404 |
| 4,719,080 | A | 1/1988 | Duhl et al. | |
| 4,908,183 | A | 3/1990 | Chin et al. | |
| 5,035,958 | A | 7/1991 | Jackson et al. | |
| 5,068,084 | A | 11/1991 | Cetel et al. | |
| 5,069,873 | A | 12/1991 | Harris et al. | |
| 5,173,255 | A | 12/1992 | Ross et al. | |
| 5,435,861 | A | 7/1995 | Khan et al. | |
| 5,443,789 | A | 8/1995 | Harris et al. | |
| 5,455,120 | A | 10/1995 | Walston et al. | |
| 5,540,789 | A | 7/1996 | Bornstein et al. | |
| 5,584,663 | A | 12/1996 | Schell et al. | |
| 5,660,649 | A | 8/1997 | Bornstein et al. | 148/404 |
| 5,740,668 | A | 4/1998 | Fujiwara et al. | 60/39.75 |
| 5,759,303 | A | 6/1998 | Mihalisin et al. | 148/428 |
| 5,888,451 | A | 3/1999 | Konter et al. | 420/448 |
| 6,051,083 | A | 4/2000 | Tamaki et al. | 148/410 |
| 6,074,602 | A | 6/2000 | Wukusick et al. | 420/433 |

OTHER PUBLICATIONS

"Improved Performance Rhenium Containing Single Crystal Alloy Turbine Blades Utilizing PPM Levels of the Highly Reactive Elements Lanthanum and Yttrium"; Ford, D.A., Fullagar, K.P.L., Bhangu, H.K., Thomas, M.C., Burkholder, P.S., Korinko, P.S., Harris, K., Wahl, J.B.; *Transactions of the ASME*, vol. 121, Jan. 1999, pp. 138–143.

"Low Density Single Crystal Superalloy CMSX–6®"; Wortmann, J., Wege R.; Harris, K, Erickson, G.L., Schwer, R.E., Presented at 7th World Conference on Investment Casting, Munich, Jun. 29–Jul. 2, 1988, 19 pages.

"Polycrystalline Cast Superalloys"; Erickson, G.L.; *ASM International*; Reprinted from *Metals Handbook®*, vol. 1, 10th Edition: Properties and Selection; 1989; 15 pages.

"The Development and Application of CMSX®–10"; Erickson, G.L.; *Superalloys 1996*, pp. 35–44.

"Superalloys in Industrial Gas Turbines—An Overview"; Wahl, J.B., Harris, K.; Presented at 9th World Conference on Investment Casting, Oct. 13–16, 1996, San Francisco, CA, USA, 12 pages.

"Superalloy Developments for Aero and Industrial Gas Turbines"; Erickson, G.L.; *ASM International® The Materials Information Society'* 1994; 15 pages.

"SNECMA Experience With Cost–Effective DS Airfoil Technology Applied Using CM 186 LC® Alloy"; Caruel, F., Bourguignon, S., Lallement, B., Fargeas, S., DeBussac, A, Harris, K., Erickson, G.L., Wahl, J.B.; ASME, *Journal of Engineering for Gas Turbines and Power*, vol. 120, Jan. 1998; pp. 97–104.

"Superalloy VIM and EBCHR Processes", Erickson, G.L., Presented at "International Symposium on Liquid Metal Processing and Casting," Santa Fe, New Mexico, Sep. 11–14, 1994; pp. 1–15.

"The Development of CMSX–5, A Third Generation, High Strength Single Crystal Superalloy"; Erickson, G.L., Harris, K., Schwer, R.E.; Presented at the 1985 TMS–AIME 114th Annual Meeting, New York; Feb. 27, 1985; 16 pages.

"The Development of CMSX®–10, A Third Generation SX Casting Superalloy", Erickson, G.L., Presented at the *Second Pacific RIM International Conference on Advanced Materials and Processing* (*PRICM–2*); Jun. 18–22, 1995; Kyongju, Korea; 10 pages.

"The Development of the CMSX®–11B and CMSX®–11C Alloys for Industrial Gas Turbine Application"; Erickson, G.L.; *Superalloys 1996; The Minerals, Metals & Materials Society*; 1996; pp. 45–52.

"Unique Single Crystal Superalloys for Industrial Gas Turbine Application"; Erickson, G.L., Presented at the *Processing and Design Issues in High Temperature Materials*, Davos, Switzerland, May 19–24, 1996; 16 pages.

"Vacuum Induction Melted Superalloys", Quigg, R.J.; Presented at the Investment Casting Seminars, Taiwan, Korea and Japan; Jan. 29–Feb. 8, 1991; 9 pages.

"A New, Third Generation, Single–Crystal, Casting Superalloy"; Erickson, G.L., Reprinted *JOM*; vol. 47, No. 4, Apr. 1995, pp. 36–39.

"CM 186 LC® Alloy Single Crystal Turbine Vanes"; Burkholder, P.S., Thomas, M.C., Helmink, R., Frasier, D.J., Harris, K., Wahl, J.B.; Presented at the International Gas Turbine & Aeroengine Congress & Exhibition ; Jun. 7–Jun. 10, 1999, pp. 1–8.

"Aero Engine Test Experience with CMSX–4® Alloy Single Crystal Turbine Blades"; Fullagar, K.P.L, Broomfield, R.W., Hulands, M., Harris, K., Erickson, G.L., Sikkenga, S.L.; *The American Society of Mechanical Engineers*; Presented at International Gas Turbine and Aeroengine Congress and Exposition ; The Hague, Netherlands; Jun. 13–16, 1994; pp. 1–12.

"Allison Engine Testing CMSX–4® Single Crystal Turbine Blades and Vanes"' Burkholder, P.S., Thomas, M.C., Frasier, D.J., Whetstone, J.R., Harris, K., Erickson, G.L., Sikkenga, S.L., Eridon, J.M.; Presented at The Institute OF Materials 3rd International Charles Parsons Turbine Conference, "Materials Engineering in Turbines and Compressors", Apr. 25–27, 1995, Civic Centre, Newcastle upon Tyne, U.K.; pp 1–16.

"Allison Manufacturing, Property and Turbine Engine Performance of CMSX–4® Single Crystal Airfoils"; Thomas, M.C., Helmink, R.C., Frasier, D.J., Whetstone, J.R., Harris, K., Erickson, G.L., Sikkenga, S.L., Eridon, J.M.; Presented at COST 501 Conference "Materials For Advanced Power Engineering 1994", Liège, Oct. 3–6, 1994; 24 pages.

"Application of the Second Generation DS Superalloy CM 186 LC® to First Stage Turbine Blading in EGT Industrial Gas Turbines"; McColvin, G.M., Sutton, J., Whitehurst, M., Fleck, D.G., Van Vranken, T.A., Harris, K., Erickson, G.L., Wahl, J.B.; Presented at The Institute of Materials, Fourth International Charles Parsons Turbine Conference, *Advances in Turbine Materials, Design and Manufacturing*; Nov. 4–6, 1997; Civic Centre, Newcastle upon Tyne, U.K., 24 pages.

"CMSX® Single Crystal, CM DS & Integral Wheel Alloys Properties & Performance"; Harris, K., Erickson, G.L. Schwer, R.E., Presented at Cost 50/501 Conference "High Temperature Alloys For Gas Turbine & Other Applications", Liège, Oct. 6–9, 1986; 20 pages.

"Coating Characterization and Evaluation of Directionally Solidified CM 186 LC® and Single Crystal CMSX–4®"; Korinko, P.S., Barber, M.J., Thomas, M.., Presented at the ASME "Turbo Expo '96"; NEC, Birmingham, U.K., Jun. 10–13, 1996; 8 pages.

"Corrosion Resistant Single Crystal Superalloys for Industrial Gas Turbine Application"; Erickson, G.L., Presented at the International Gas Turbine & Aeroengine Congress & Exhibition, Orlando, Florida, Jun. 2–5, 1997; pp. 1–12.

"Ni–Based Superalloy Developments"; Erickson, G.L.; *Critical Issues in the Development of High Temperature Structural Materials; TMS Minerals • Metals • Materials*; 1993; pp. 87–105.

"Design of a High Efficiency Industrial Turbine Blade Utilizing Third Generation Single Crystal Alloy CMSX®–10"; Fitzpatrick, M.D., Brentnall, W.D., Meier, A., Erickson, G.L., DeBoer, G.; Presented at the International Gas Turbine & Aeroengine Congress & Exhibition, Orlando, Florida, Jun. 2–5, 1997; pp. 1–9.

"Development and Turbine Engine Performance of Three Advanced Rhenium Containing Superalloys for Single Crystal and Directionally Solidified Blades and Vanes"; Broomfield, R.W., Ford, D.A., Bhangu, J.K., Thomas, M.C., Frasier, D.J., Burkholder, P.S., Harris, K., Erickson, G.L., Wahl, J.B.; *Journal of Engineering for Gas Turbines and Power*; vol. 120; Jul. 1998; pp 595–608.

"Development of High Creep Strength, High Ductility, Cast Superalloy for Integral Turbine Wheels—CM MAR–M–247 LC—"; Harris, K., Erickson, G.L., Schwer, R.E.; 1982 AIME Annual Meeting; Dallas, Texas; Feb. 17, 1982; pp. 1–30.

"Development of the Rhenium Containing Superalloys CMSX–4® & CM 186 LC® for Single Crystal Blade and Directionally Solidified Van Applications in Advanced Turbine Engines"; Harris, K., Erickson, G.L., Kikkenga, S.L., Brentnall, W.D., Aurrecoechea, J.M., Kubarych, K.G.; Presented at the Seventh International Symposium on Superalloys, Seven Springs, Sep. 20–24th, 1992; 10 pages.

"Development of the CM SX* Series of Single Crystal Alloys for Advanced Technology Turbine Components"; Harris, K., Erickson, G.L., Schwer, R.E.; Presented at the 1982 TMS–AIME Fall Meeting, St. Louis, Missouri; Oct. 27, 1982; pp. 1–36.

"Development of the Rhenium Containing Superalloys CMSX–4® for Single Crystal Blade Applications in Advanced Turbine Engines"; Harris, K., Erickson, G.L., Sikkenga, S.L., Brentnall, W.D., Aurrecoechea, J.M., Kubarych, K.G.; Presented at the Seventh International Symposium on Superalloys, Seven Springs, Sep. 20–24th, 1992; 10 pages.

"Directionally Solidified and Single–Crystal Superalloys"; Harris, K., Erickson, G.L., Schwer, R.E.; Reprinted from *Metal Handbook*®; vol. 1, 10th Edition, 14 pages.

"Directionally Solidified DS CM 247 LC—Optimized Mechanical Properties Resulting From Extensive$\gamma$' Solutioning"; Erickson, G.L., Harris, K., Schwer, R.E.; Presented at the Gas Turbine Conference and Exhibit, Hourston, Texas; Mar. 18–21, 1985; pp. 1–10.

"DS and SX Superalloys for Industrial Gas Turbines"; Erickson, G.L., Harris, K.; Presented at the 5$^{th}$ Liège Conference on "Materials For Advanced Power Engineering 1994", Oct. 3–6, 1994; 20 pages.

* cited by examiner

552 MPa/843°C $\Delta\varepsilon = 0.95\%/538°C/R = 0/Kt=1$

HIP = HEAT TREATMENT OPTIMIZATION RESULTS.
[SPECIMENS TAKEN FROM THE DISC PORTION OF THE WHEEL.]

HUB STRESS – RUPTURE RESULTS. [SPECIMENS TAKEN FROM THE DISC PORTION OF THE WHEEL.]

AIRFOIL MINIFLAT STRESS – RUPTURE RESULTS
[EQUIAXED (GX) SPECIMENS.]

HUB LCF RESULTS [SINCE THE CRITICAL POINT OF THE WHEEL OPERATES AT HIGH STRAIN RANGES, THESE CURVE SHAPES ARE FAVORABLE FOR IG ALLOYS OF THE INVENTION].

HUB FCG RESULTS CM 681 ALLOY SHOWS AN ADVANTAGE IN CRACK GROWTH RESISTANCE COMPARED TO THE BASELINE MAR-M247 ALLOY.

NICKEL-BASE SUPERALLOY FOR HIGH TEMPERATURE, HIGH STRAIN APPLICATION

CROSS-REFERENCE TO RELATED APPLICATION

This application claims priority under 35 U.S.C. §119(e) on U.S. Provisional Application No. 60/232,822 (unofficial) entitled NICKEL-BASE SUPERALLOY FOR HIGH TEMPERATURE, HIGH STRAIN APPLICATION, filed Sep. 15, 2000, by Kenneth (NMI) Harris, the entire disclosure of which is incorporated herein by reference.

FIELD OF THE INVENTION

This invention relates to superalloys exhibiting superior mechanical properties, and more particularly to superalloys useful for high temperature, high strain applications, such as components of aircraft gas turbine engines.

BACKGROUND OF THE INVENTION

Nickel-base superalloys are well known for their superior mechanical strength at high temperatures. As a result, such alloys have been beneficially employed in aircraft gas turbine engines to permit higher temperature operation and improved efficiency.

However, there is a recognized need in both the aerospace and power generation gas turbine industry for lower cost advanced technology materials. More specially, there is a need for the development of advanced superalloy materials and manufacturing processes that make it possible to produce affordable, integrally bladed turbine wheels exhibiting significantly increased low cycle fatigue (LCF) life and improved airfoil stress rupture life.

Traditionally, the discs or hubs of gas turbines have been formed in a forging process, and the blades in a casting process. The blades are then attached to the disc or hub mechanically. The reason for using separate forming processes is that the discs or hubs preferably have an equiaxed grain structure, giving them maximum tensile strength and low cycle fatigue properties. Preferably, the blades should have a directionally solidified (DS) columnar grain structure, or even a single crystal structure, in order to avoid high temperature creep failure created by lateral grain structure, i.e., grain structure extending transverse with respect to the longitudinal axis (major stress direction) of the blade.

Techniques have been developed to integrally cast the blade and hub in such a way as to obtain directionally solidified, columnar grain blades and equiaxed grain hubs for small integral turbine wheels. Unfortunately, the alloys currently available are better suited to form either an equiaxed grain structure or a directionally solidified, columnar grain structure. High creep strength alloys have not been available which perform well in both grain structures.

As a result, the integrally cast blade and hub gas turbine wheels which have heretofore been utilized commercially have utilized an equiaxed grain structure.

SUMMARY OF THE INVENTION

The present invention provides nickel-base superalloys that perform well in both an equiaxed and directionally solidified, columnar grain structure. These alloys exhibit increased grain boundary strength and ductility while maintaining microstructural stability. The improved grain boundary strength and ductility allow both directionally solidified columnar grain casting and equiaxed casting of an integrally bladed cast turbine wheel that will provide superior capabilities at a substantially lower cost when compared to conventional turbine wheels having blades that are separately cast and mechanically attached to a forged turbine disc.

The nickel-base alloys associated with this invention are particularly characterized by a relatively low titanium content and a relatively high tantalum content. The relatively low titanium content (about 0.25% by weight or less) reduces decomposition of titanium carbides during the necessary post-cast hot isostatic pressing (HIP). The relatively high tantalum content of 5.9–6.3 by weight produces grain boundaries comprising of discrete tantalum carbides that remain stable upon hot isostatic pressure treatment, and therefore preserves high grain boundary strength and ductility after the hot isostatic pressure treatment. Although a low titanium content is desired, it has been found that some titanium is needed (at least about 0.05% by weight) to provide excellent fatigue crack growth resistance. Similarly, the tantalum content should not be either too high to too low. The nickel-base alloys of this invention are also characterized by a relatively high refractory element content (tungsten, tantalum, rhenium and molybdenum).

These and other features, advantages and objects of the present invention will be further understood and appreciated by those skilled in the art by reference to the following specification, claims and appended drawings.

DESCRIPTION OF THE PREFERRED EMBODIMENTS

Figure 1:
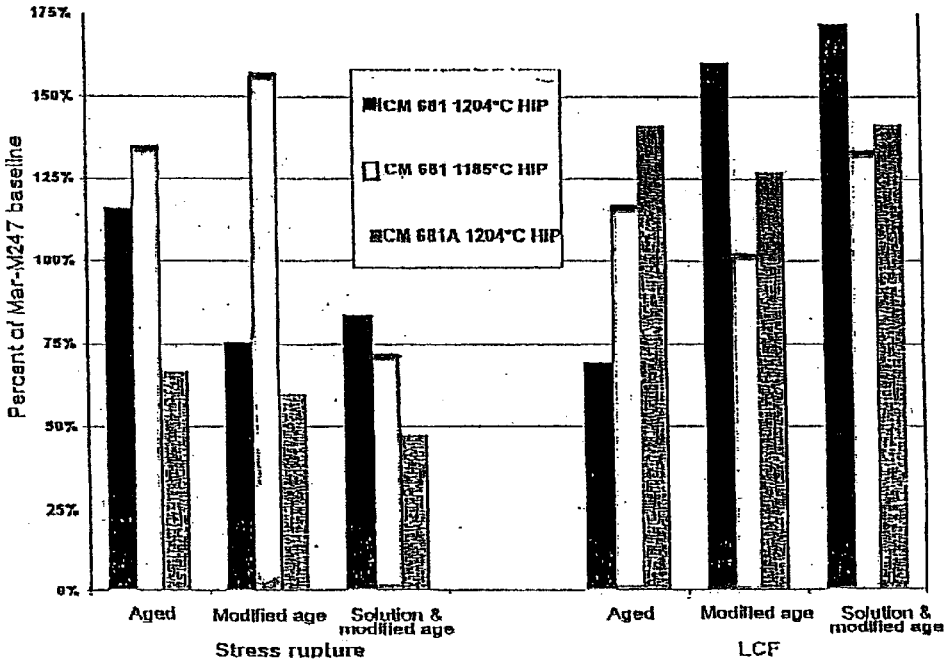
FIG. 1 compares the stress rupture and low cycle fatigue (LCF) test results for turbine wheels cast using alloys of this invention with the test results of turbine wheels cast from conventional alloy Mar-M 247.

The unique ability of the alloys of this invention to be employed in casting processes involving both equiaxed casting techniques and directional solidification casting techniques to produce a casting having both an equiaxed, fine grain structure on one section of the casting and a columnar grain structure on another section of the casting, and be subjected to post-cast hot isostatic pressing, while exhibiting improved mechanical properties (as compared with conventional nickel-base superalloys used for casting turbine wheels, such as Mar-M 247 alloy) is attributable to the relatively narrow compositional ranges defined herein. Turbine wheels made using the alloys of this invention, and the combination of equiaxed casting at the hub portion of the wheel and directional solidification casting of integrally cast blades, followed by hot isostatic pressing of the casting, provides improved engine performance and component life benefits.

The amounts of the various elements contained in the alloys of this invention are expressed in percentages by weight unless otherwise noted.

The nickel-base superalloys of the preferred embodiments of this invention include, in percentages by weight, 5–6 chromium, 9–9.5 cobalt, 0.3–0.7 molybdenum, 8–9 tungsten, 5.9–6.3 tantalum, 0.05–0.25 titanium, 5.6–6.0 aluminum, 2.8–3.1 rhenium, 1.1–1.8 hafnium, 0.10–0.12 carbon, 0.010–0.024 boron, 0.011–0.020 zirconium, the balance being nickel and incidental impurities. As a result of the increased grain boundary strength and ductility, the nickel-base superalloy compositions of this invention can be cast to form gas turbine engine components that are capable of exhibiting a doubling or tripling of useful life, and significantly reducing life cycle cost. The alloys of this invention also exhibit significantly improved low cycle fatigue life, and improved airfoil high temperature stress rupture life.

In accordance with a more preferred aspect of the invention there is provided a nickel-base superalloy (CM designation CM 681) comprising in percentages by weight, 5.5 chromium (Cr), 9.3 cobalt (Co), 0.50 molybdenum (Mo), 8.4 tungsten (W), 6.1 tantalum (Ta), 0.15 titanium (Ti), 5.7 aluminum (Al), 2.9% rhenium (Re), 1.5% hafnium (Hf), 0.11 carbon (C), 0.018 boron (B), 0.013 zirconium (Zr), the balance being nickel and incidental impurities.

Rhenium (Re) is present in the alloy to slow diffusion at high temperatures, restrict growth of the γ' precipitate strengthening phase, and thus improve intermediate and high temperature stress-rupture properties (as compared with a conventional nickel-base alloys such as Mar-M 247). It has been found that about 3% rhenium provides improved stress-rupture properties without promoting the occurrence of deleterious topologically-close-packed (TCP) phases (Re, W, Cr), providing the other elemental chemistry is carefully balanced. The chromium content is preferably from about 5.0% to about 5.8%, with a suitable range being from about 5% to about 6%. Rhenium is known to partition mainly to the γ matrix phase which consists of narrow channels surrounding the cubic γ' phase particles. Clusters of rhenium atoms in the γ' channels inhibit dislocation movement and therefore restrict creep. Walls of rhenium atoms at the γ/γ' interfaces restrict γ' growth at elevated temperatures.

An aluminum content at about 5.7% by weight, tantalum at about 6.1% by weight and titanium at about 0.15% by weight result in about a 70% volume fraction at the cubic γ' phase ($Ni_3Al$, Ta, Ti) with low and negative γ–γ' mismatch at elevated temperatures. Tantalum increases the strength of both the γ and γ' phases through solid solution strengthening. The relatively high tantalum and very low titanium content, as compared to a conventional nickel-base superalloy (such as Mar-M 247 alloy) ensure predominate formation of relatively stable tantalum carbides (TaC) to strengthen grain boundaries and therefore ensure that the alloy is amenable to high temperature (about 2,165° F. or about 1,185° C.) post-cast hot isostatic pressing.

Titanium carbides (TiC) tend to dissociate or decompose during hot isostatic pressing, causing thick γ' envelopes to form around the remaining titanium carbide and precipitation of excessive hafnium carbide (HfC), which lowers grain boundary and γ–γ' eutectic phase region ductility by tying up the desirable hafnium atoms. The best overall results were obtained with an alloy containing about 0.15% titanium. This may be due to the favorable effect of titanium on γ–γ' mismatch. A suitable titanium content is 0.05–0.25%, and preferably 0.10–0.20%.

Further solid solution strengthening is provided by molybdenum (Mo) at about 0.50% and tungsten (W) at about 8.4%. A tungsten content of from about 8–9% by weight is suitable, with a preferred range being 8.1–8.7%. A suitable range for the molybdenum content is 0.3–0.7%, with a preferred range being 0.4–0.6%. Approximately 50% of the tungsten precipitates in the γ phase, increasing both the volume fraction ($V_f$) and strength.

Cobalt in an amount of about 9.3% provides maximized $V_f$ of γ', and chromium in an amount of about 5.5% provides acceptable hot corrosion (sulfidation) resistance, while allowing a high level of refractory metal elements (W, Re, Ta, and Mo, the total amount of refractory metal elements being about 17.9%) in the nickel matrix, without the occurrence of topologically-close-packed phases during stressed, high temperature turbine engine service exposure.

Hafnium (Hf) is present in the alloy at about 1.5% to provide good grain boundary, and intermediate temperature ductility. Suitable and preferred ranges for the hafnium content are 1.1–1.8 and 1.2–1.7, respectively.

Carbon (C), boron (B) and zirconium (Zr) are present in the alloy in amounts of about 0.11%, 0.018% and 0.013%, respectively, to impart the necessary grain boundary microchemistry and carbides/borides needed for strength and ductility in equiaxed form, while providing adequate directionally solidified columnar grain castability, i.e., reduce the propensity of the alloy to exhibit directionally solidified columnar grain boundary cracking. The relatively high aluminum and low titanium content, and the modest chromium content in the alloy insures that the alloy is highly oxidation resistant.

The superalloys of this invention may contain trace or trivial amounts of other constituents which do not materially affect their basic and novel characteristics. Such other trace constituents may include, for example, copper and iron and like elements commonly encountered in trace amounts in the constituents used. However, it is desirable that the amount of silicon, manganese, phosphorous, sulfur, iron, copper, vanadium, columbium, nitrogen, oxygen and other impurities be as low as possible.

The superalloys of the present invention are especially well suited for production of components using columnar grain and single crystal, directional solidification casting, and equiaxed casting techniques. The alloys are also amenable to HIP processing. Directional solidification techniques are well known in the art (see for example U.S. Pat. No. 3,260,505).

The intentional control and limitation of the various elements of the composition provide an alloy that can be directionally solidified, in selected areas of a casting, and equiaxed cast in other selected areas to form an integral cast component having a blade airfoil section with a directional columnar grain structure, and another disc or hub section with an equiaxed grain structure. More specifically, the alloy may be used for casting hot isostatic pressure (HIP) treated integrally bladed turbine wheels having a hub section with an equiaxed (polycrystalline) grain structure, and integrally cast blades having a directionally solidified, columnar grain structure. The resulting hot isostatic pressure treated casting formed from the alloy of this invention exhibits outstanding oxidation resistance and resistance to grain boundary and fatigue cracking under high temperature conditions, and upon repeated thermal cycling. The integrally cast blades are directionally solidified and have a columnar grain structure to eliminate transverse grain boundaries in the blades, thus improving strength, ductility, high temperature creep and other mechanical properties such as thermal fatigue. The columnar grain structure prevents elongation and/or cracking at high temperature and high strain conditions, through the elimination of transverse (to its principal stress) grain boundaries and establishment of (001) crystallographic orientation, parallel to the principal stress axis along the length of the blade.

COMPARATIVE STUDIES

An important feature of the superalloys of this inventions is that the particular combination of elements provides high grain boundary strength after hot isostatic pressing, whereas many of the conventional nickel-base superalloys do not exhibit the desired carbide phasal stability needed to prevent formation of undesirable phases during heat treatment that would result in inferior mechanical properties.

Previous attempts to make castings of integrally turbine wheels having a hub section with an equiaxed grain structure and blades having a directionally solidified, columnar grain structure using certain conventional nickel-base superalloys have been unsuccessful because of inadequate creep rupture properties. A number of studies were conducted comparing an alloy made in accordance with this invention (CM 681) to a number or prior art alloys and to an experimental alloy (CM 681 A) having a composition outside of the scope of this invention. These alloys and their compositions (in wt %) are indicated in Table I.

TABLE I

| | Compositions in wt %. | | | | | | | | | | | | | |
|---|---|---|---|---|---|---|---|---|---|---|---|---|---|---|
| Alloy | Cr | Co | Mo | W | Re | Nb | Ta | Al | Ti | Hf | C | B | Zr | Ni |
| Mar-M 247 | 8.4 | 10 | 0.65 | 10 | | | 3.1 | 5.5 | 1 | 1.4 | 0.16 | 0.015 | 0.05 | Bal |
| CM 186LC ® | 6 | 9 | 0.5 | 8 | 3 | | 3 | 5.7 | 0.7 | 1.4 | 0.07 | 0.015 | 0.005 | Bal |
| CM 186 Mod | 5.9 | 9.4 | 0.4 | 8.5 | 3 | | 3.3 | 5.7 | 0.75 | 1.5 | 0.09 | 0.019 | 0.01 | Bal |
| CM 681* | 5.4 | 9.3 | 0.5 | 8.5 | 3 | | 6.2 | 5.7 | 0.15 | 1.6 | 0.11 | 0.018 | 0.015 | Bal |
| CM 681 A** | 5 | 9.3 | 0.5 | 9 | 3 | | 6.9 | 5.7 | | 1.6 | 0.11 | 0.018 | 0.025 | Bal |
| CMSX-10 ® | 2 | 3 | 0.4 | 5 | 6 | 0.05 | 8 | 5.7 | 0.2 | 0.03 | | | | Bal |
| CM 4670 | 4 | 3.4 | 0.5 | 5 | 5.3 | 0.05 | 8 | 5.7 | 0.13 | 1.2 | 0.09 | 0.017 | 0.015 | Bal |
| CM 4670C | 2.7 | 3.2 | 0.4 | 5 | 6 | 0.05 | 8 | 5.7 | 0.08 | 1.2 | 0.05 | 0.02 | 0.025 | Bal |

*CM 681 is in accordance with the invention.
**CM 681 A is an experimental alloy not in accordance with the invention.

For example, a commercially available DS nickel-base superalloy (CM 186 LC)® exhibited inadequate creep rupture properties when equiax cast. Other nickel-base superalloys exhibited severe airfoil cracking when equiax cast. For example, derivatives of the commercially available nickel-base superalloy CMSX-10® designated CM 4670 and CM 4670C exhibited severe airfoil cracking evident upon fluorescent penetrant inspection.

Still other conventional nickel-base superalloys have exhibited inadequate phasal stability, and inadequate carbide and/or boride grain boundary microstructural stability, and were unable to withstand high temperature post-casting thermal processing (HIP) required for fine grain hub integrally cast turbine wheels, e.g., hot isostatic pressing, typically at a temperature of about 1200° C. and a pressure of about 200 MPa for several hours. For example, the derivatives of the commercially available superalloy designated CMSX-10® exhibited inadequate phasal stability to withstand high temperature postcasting thermal processing that is required for production of integrally cast turbine wheels with fine grain hubs. Other known nickel-base superalloys were significantly weaker than the advanced alloys of this invention. For example, the derivative of the commercially available nickel-base superalloy designated CM 186 MOD was noticeably weaker than other advanced alloys.

A series of turbine wheels having integrally cast blades were prepared using a casting technique in which the blades were directionally solidified to provide a columnar grain structure, and the hubs were solidified to provide a fine equiaxed grain structure. Wheels were cast from an alloy (CM 681) in accordance with the invention, a similar alloy having no titanium (CM 681 A), and a conventional superalloy (Mar-M 247).

A first series of turbine wheels were hot isostatic pressed (HIP) at 200 MPa for four (4) hours at temperatures ranging from 1185 to 1218° C., for hot isostatic pressing assessment studies. The initial metallographic examination of the hot isostatic pressed wheels for pore closure used specimens taken from the central hub region. The central hub is the thickest part of the casting and the last area to solidify; therefore, it was believed to be the area most prone to microshrinkage and the last area that hot isostatic pressing would close. Specimens removed from the central hub area of these wheels showed no evidence or residual microporosity. Subsequently, it was also decided to examine specimens from the web and rim areas for residual porosity, because small microshrinkage was occasionally observed on the fracture surfaces of the failed stress rupture bars. Surprisingly, several small pores with incomplete closure were located in the center of the rim area. Presumably, the greater susceptibility to microporosity in the rim area is related to the forced fluid flow during solidification associated with fine grain casting process. The maximum pore size observed was 3 millimeters (mm) and was generally less than 1 mm.

It was determined this small amount of residual porosity would be inconsequential to engine performance. It was concluded from the hot isostatic pressing assessment studies that minimizing the hot isostatic pressing temperature was beneficial to mechanical properties with the advanced alloys. Accordingly, one wheel each of alloy CM 681 and CM 681 A were hot isostatic pressed at 1204° C./200 MPa/4 hr and a second CM 681 alloy wheel was not isostatic pressed at 1185° C./200 MPa/4 hr. One group of specimens from each wheel received the standard age of 1093° C./2 hr/gas fan cooling +871° C./20 hr/gas fan cooling. A second group received a modified age of 1038° C./2 hr/gas fan cooling+871° C./20 hr/gas fan cooling. A third group received a 1204° C./2 hr/gas fan cooling partial resolution followed by the modified double age.

The stress rupture lives at 138 MPa/1038° C. were 200 to 300% of baseline equiaxed Mar-M 247 lives for both advanced alloys and all three thermal processing conditions. The results from stress rupture tests conducted at 552

MPa/843° C. are presented in FIG. 1. The lower temperature processing appeared to provide a significant improvement in the rupture life. The CM 681 alloy exhibited a somewhat higher rupture life than the CM 681 A alloy. The low cycle fatigue testing results are also shown in FIG. 1. Most of the advanced alloy and thermal processing combinations provided improved low cycle fatigue lives compared to the baseline equiaxed Mar-M 247 material examined. It also appears the resolutioning after HIP offers a benefit to fatigue life.

Overall, the 1185° C. hot isostatic pressing followed by the modified age appeared to offer the best balance of properties, and this thermal processing was selected for the balance of the CM 681 and CM 681 A wheels.

The balance of the testing included room temperature and 538° C. tensile tests, stress rupture tests, low cycle fatigue test at 538° C., and crack growth testing at 538° C. The tests were all performed using material removed from the disk portion of the wheel. In addition, airfoil miniflat stress rupture tests were conducted.

The 0.2% yield strength and ultimate tensile strength of the CM 681 alloy was somewhat lower than the values achieved for this alloy in the first iteration and closer to the strength levels of Mar-M 247. This represents the desired result, since a higher strength could is disrupt the required burst sequence between the first-stage and second-stage turbine wheels and thereby force a turbine engine redesign. No significant difference was observed in strength or ductility between CM 681 and CM 681 A.

Figure 2:
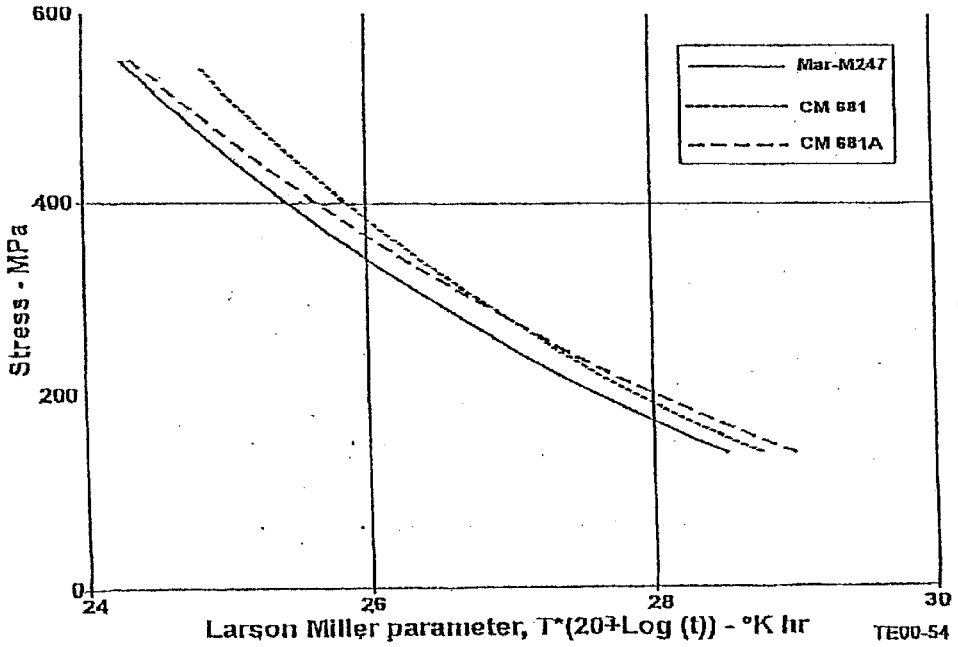
FIG. 2 shows hub stress rupture results for equiaxed alloy variants, verses conventional alloy Mar-M 247.

Stress rupture results for the hub portion of the wheels are shown in FIG. 2. Both advanced alloy performed significantly better than the baseline Mar-M 247 alloy at all stress levels. Compared to the results of the CM 186 derivative alloys in the first iteration, it is evident the second-iteration thermal processing provides better performance in the high stress portion of the curve while maintaining an advantage over Mar-M 247 in the low stress region. CM 681 performed slightly better than CM 681 A at lower stresses and CM 681 A was superior at high stresses.

Figure 3:
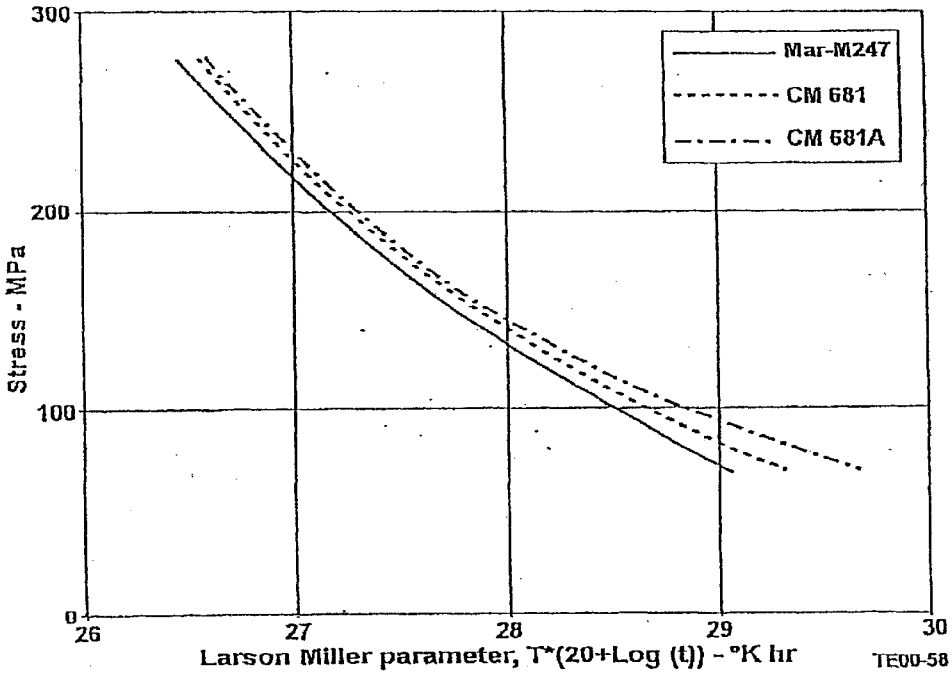
FIG. 3 shows airfoil miniflat stress rupture results for equiaxed alloy variants verses conventional alloy Mar-M 247.

The airfoil miniflat stress rupture test results are provided in FIG. 3. The advanced alloys are clearly superior to the baseline Mar-M 247 alloy throughout the stress range investigated. This is in stark contrast to the first-iteration results in which the advanced alloys were dramatically inferior to the baseline material at high stresses. The CM 681 A alloy exhibited a small advantage over the CM 681 alloy at higher stresses and a more distinct advantage in the low stress region.

Figure 4:
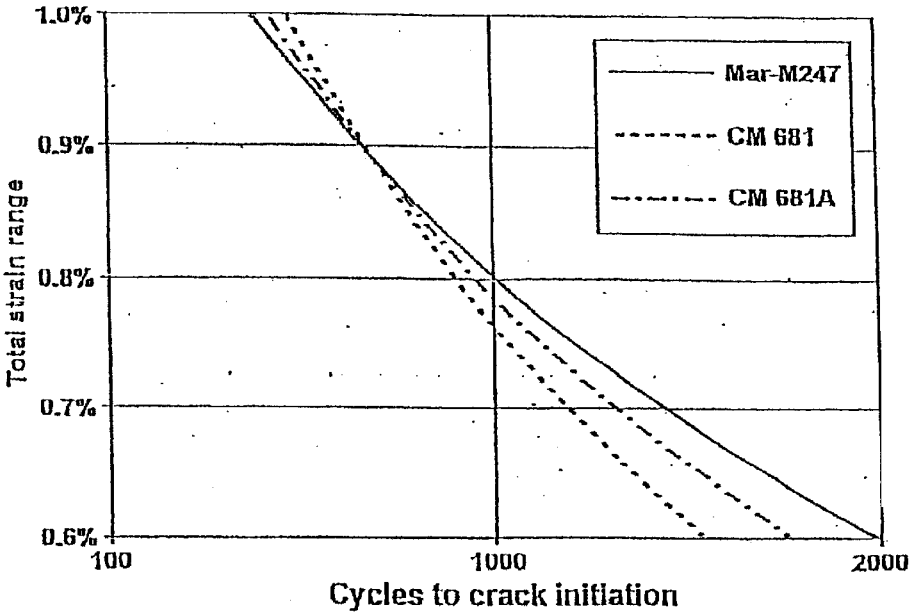
FIG. 4 is a graph comparing hub low cycle fatigue for alloy castings of the invention with castings from the conventional alloy Mar-M 247.

The low cycle fatigue test results are shown in FIG. 4. The CM 681 and CM 681 A alloys performed similarly. Both alloys were superior to Mar-M 247 in the low life, high strain range portion of the curve and inferior to the baseline in the high life, low strain range region. Since the critical portion of the wheel operates at high strain ranges, these curve shapes are favorable for the advanced alloys. This is the same trend observed in the first-iteration results for the CM 681 and CM 681 A alloys, indicating the alternative thermal processing had only a minor effect on low cycle fatigue properties.

Figure 5:
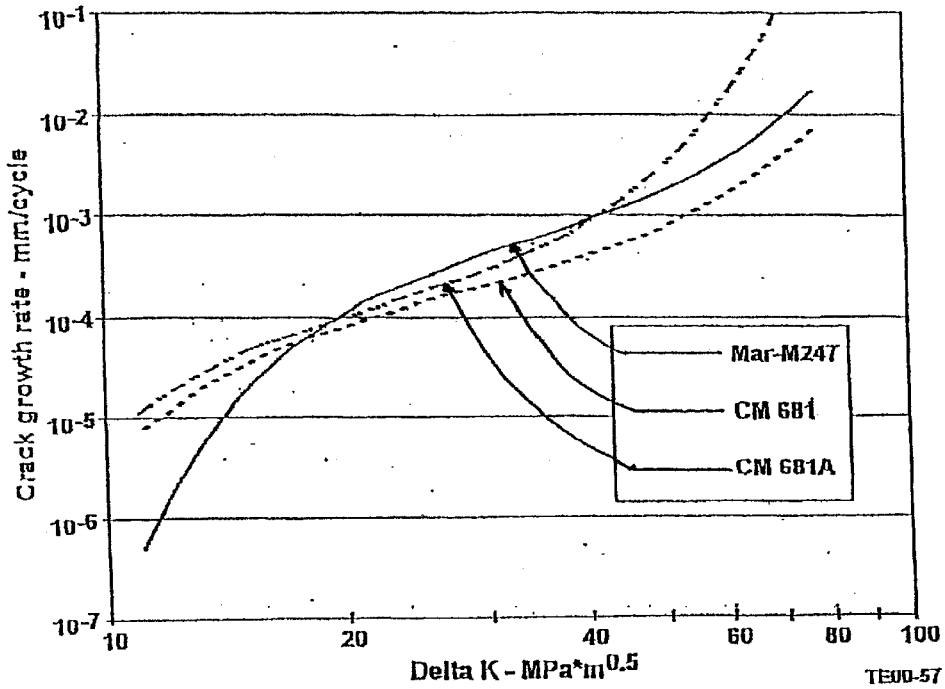
FIG. 5 is a graph comparing fatigue crack growth (FCG) for alloy castings of the invention with castings from the convention alloy Mar-M 247.

The fatigue crack growth test results are provided in FIG. 5. The CM 681 A alloy was similar to the baseline Mar-M 247 material. The CM 681 alloy appears to offer a significant advantage in crack growth resistance compared to the baseline. Crack growth tests tend to be variable and the extent of testing conducted on this program was limited. Nevertheless, the CM 681 results were encouraging and would provide a major benefit to integral turbine wheel life if this advantage is realized in engine testing.

Test bars were cast from an alloy having a composition in accordance with the invention to evaluate mechanical properties. A chemical analysis of the alloy used for the test bars revealed the following composition:

| Chemistry (Wt. % or ppm) CM 681 LC Alloy [CM 681] CM Heat VG 216 | | | | | | | | | | | | | | | |
|---|---|---|---|---|---|---|---|---|---|---|---|---|---|---|---|
| C | SI | Mn | S | Al | B | Cb | Co | Cr | Cu | Fe | Hf | Mg | Mo | [N] | Ni |
| .109 | <.01 | <.001 | ppm 2 | 5.70 | .018 | <.05 | 9.3 | 5.4 | <.001 | .025 | 1.6 | ppm 13 | .48 | ppm 2 | BAL |
| [O] | P | Re | Ta | Ti | W | Zr | V | Y | Ag | Bi | Ga | Pb | Se | Te | Tl |
| ppm 2 | ppm <2 | 2.9 | 6.2 | .17 | 8.5 | .013 | <.005 | <.001 | ppm <1 | ppm <.2 | ppm <10 | ppm <.5 | ppm <.5 | ppm <.2 | ppm <.2 |
| Sn | Sb | As | Zn | Hg | U | Th | Cd | Ge | Pt | Au | In | Na | K | | |
| ppm <5 | ppm <1 | ppm <1 | ppm <1 | ppm <2 | ppm <.5 | ppm <.5 | ppm <.2 | ppm <1 | <.001 | ppm <.5 | ppm <.2 | ppm <10 | ppm <5 | | |

The test bars were conventionally cast to form a polycrystalline, equiaxed grain structure, and double age heat treated [2 hours/2,000° F./gas fan cooling +20 hours/1,600° F./gas fan cooling]. A comparison of room temperature (RT) tensile strength at 0.2% elongation [proof strength (PS), sometimes inaccurately referred to as yield strength], room temperature ultimate tensile strength, elongation, and reduction in area (RA, a measure of ductility), for a test bar made from the above-referenced CM 681 alloy and typical data for a test bar made from a conventional nickel-base superalloy (Mar-M 247) are shown in Table I.

TABLE I

| | 0.2% PS | Ultimate Tensile Strength | Elongation % 4D | RA % |
|---|---|---|---|---|
| CM 681 | 128.9 | 162.8 | 6.9 | 9.4 |
| Mar-M 247 | 120 | 140 | 7 | 7 |

[As-Cast + 20 hrs/1600° F. AC] (871° C.)

A comparison of stress-rupture properties for CM 681 and Mar-M 247 alloy under two different sets of stress loads/ temperature conditions are shown in Tables II and III respectfully.

TABLE II

| Stress-Rupture 80 ksi/1550° F. [552 MPa/843° C.] | | | |
|---|---|---|---|
| | Rupture Life hrs. | Elongation % 4D | RA % |
| CM 681 (Specimen 1) | 102.6 | 3.2 | 4.1 |
| CM 681 (Specimen 2) | 151.5 | 6.2 | 5.4 |
| MAR-M 247 | 50 | NA | NA |

[As-Cast + 20 hrs/1600° F. AC] (871° C.)

TABLE III

| 20 ksi/1900° F. [138 MPa/1038° C.] | | | |
|---|---|---|---|
| | Rupture Life hrs. | Elongation % 4D | RA % |
| CM 681 (Specimen 1) | 119.5 | 3 | 4.1 |
| CM 681 (Specimen 2) | 115.2 | 4 | 3.6 |
| MAR-M 247 | 60 | NA | NA |

[As-Cast + 20 hrs/1600° F. AC] (871° C.)

The data show that an equiaxed casting prepared from an alloy in accordance with the invention exhibits superior tensile strength and rupture life, as compared with a conventional nickel-base superalloy (Mar-M 247), while exhibiting comparable elongation and ductility properties. This demonstrates that the alloy is also useful for forming castings having a polycrystalline equiaxed grain structure.

A turbine wheel hub was cast having a fine grain equiaxed structure using the CM 681 alloy described above. The cast hub was hot isostatic pressed at 29 ksi/2,165° F. for 4 hours (200 MPa/1,185° C.), and subsequently heat treated [2 hours/1,900° F. (1,038° C.)/gas fan cooled +20 hours/1,600° F. (871° C.)/gas fan cooled]. The hubs were then subjected to stress-rupture testing. A comparison of stress-rupture properties for the CM 681 hub as compared with the Mar-M 247 hub at two different pressure/temperature conditions is shown in Table IV and Table V, respectively. The results demonstrate superior stress-rupture properties for a hub cast from an alloy of the invention with a crystalline, equiaxed, fine grain structure, as compared with a hub cast from a conventional nickel-base superalloy, while exhibiting comparable elongation and ductility properties.

TABLE IV

| Stress-Rupture 80 ksi/1550° F. [552 MPa/843° C.] | | | |
|---|---|---|---|
| | Rupture Life hrs. | Elongation % 4D | RA % |
| CM 681 (Specimen 1) | 95.8 | 3.2 | 3.4 |
| CM 681 (Specimen 2) | 69.8 | 3.7 | 2.8 |

TABLE V

| 20 ksi/1900° F. [138 MPa/1038° C.] | | | |
|---|---|---|---|
| | Rupture Life hrs. | Elongation % 4D | RA % |
| CM 681 (Specimen 1) | 138.7 | 4.8 | 2.1 |
| CM 681 (Specimen 2) | 169.6 | 7.1 | 4.3 |

Based on the above data, it is readily apparent that the nickel-base superalloys of this invention may be advantageously employed for casting components, such as a turbine blade, turbine vane, or integral turbine nozzle ring, having a crystalline equiaxed grain structure.

In summary, both CM 681 and CM 681 A exhibit significant advantages over the baseline Mar-M 247 material. CM 681 was selected for the manufacturing scale-up because of its potential for greatly increased crack growth resistance.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A nickel-base superalloy consisting of in percentages by weight, 5–6 Cr, 9–9.5 Co, 0.3–0.7 Mo, 8–9 W, 5.9–6.3 Ta, 0.05–0.25 Ti, 5.5–6.0 Al, 2.8–3.1 Re, 1.1–1.18 Hf, 0.10–0.12 C, 0.010–0.024 B, 0.011–0.02 Zr the balance being nickel and incidental impurities.

2. The nickel-base superalloy of claim 1, wherein the percentage by weight of titanium is 0.10–0.20.

3. The nickel-base superalloy of claim 1, wherein the percentage by weight of chromium is 5.0–5.8.

4. The nickel-base superalloy of claim 1, wherein the percentage by weight of molybdenum is 0.4–0.6.

5. The nickel-base superalloy of claim 1, wherein the percentage by weight of tungsten is 8.1–8.7.

6. The nickel-base superalloy of claim 1, wherein the percentage by weight of hafnium is 1.2–1.7.

7. The nickel-base superalloy of claim 1, wherein the percentages by weight are about 5.5 Cr, 9.3 Co, 0.50 Mo, 8.4 W, 6.1 Ta, 0.15 Ti, 5.7 Al, 2.9 Re, 1.5 Hf, 0.11 C, 0.018 B, 0.013 Zr, the balance being nickel and incidental impurities.

8. A casting prepared from a nickel-base superalloy consisting of in percentages by weight, 5–6 Cr, 9–9.5 Co, 0.3–0.7 Mo, 8–9 W, 5.9–6.3 Ta, 0.05–0.25 Ti, 5.5–6.0 Al, 2.8–3.1 Re, 1.1–1.8 Hf, 0.10–0.12 C, 0.010–0.024 B, 0.011–0.02 Zr the balance being nickel and incidental impurities.

9. The casting of claim 8, wherein the percentage by weight of titanium is 0.10–0.20.

10. The casting of claim 8, wherein the percentage by weight of chromium is 5.0–5.8.

11. The casting of claim 8, wherein the percentage by weight of molybdenum is 0.4–0.6.

12. The casting of claim 8, wherein the percentage by weight of tungsten is 8.1–8.7.

13. The casting of claim 8, wherein the percentage by weight of hafnium is 1.2–1.7.

14. The casting of claim 8, wherein a portion of the casting has an equiaxed fine grain structure, and another portion of the casting has a directionally solidified columnar grain structure.

15. The casting of claim 8, wherein the percentages by weight of the nickel-base superalloy are about 5.5 Cr, 9.3 Co, 0.50 Mo, 8.4 W, 6.1 Ta, 0.15 Ti, 5.7 Al, 2.9 Re, 1.5 Hf, 0.11 C, 0.018 B, 0.013 Zr, the balance being nickel and incidental impurities.

16. The casting of claim 14, wherein the percentages by weight of the nickel-base superalloy are about 5.5 Cr, 9.3 Co, 0.50 Mo, 8.4 W, 6.1 Ta, 0.15 Ti, 5.7 Al, 2.9 Re, 1.5 Hf, 0.11 C, 0.018 B, 0.013 Zr, the balance being nickel and incidental impurities.

17. The casting of claim 8, wherein the casting is a turbine wheel having integrally cast blades, with the blades having a directionally solidified columnar grain structure, and the hub or disc portion having an equiaxed fine grain structure.

18. The casting of claim 8, that is conventionally cast with a polycrystalline equiaxed grain structure.

19. The casting of claim 18, wherein the percentages by weight of the nickel-base superalloy are about 5.5 Cr, 9.3 Co, 0.50 Mo, 8.4 W, 6.1 Ta, 0.15 Ti, 5.7 Al, 2.9 Re, 1.5 Hf, 0.11 C, 0.018 B, 0.013 Zr, the balance being nickel and incidental impurities.

20. The casting of claim 18, wherein the casting is a turbine blade or a turbine vane, or an integral turbine nozzle ring.

* * * * *

UNITED STATES PATENT AND TRADEMARK OFFICE

CERTIFICATE OF CORRECTION

PATENT NO. : 6,632,299 B1
DATED : October 14, 2003
INVENTOR(S) : Kenneth Harris

It is certified that error appears in the above-identified patent and that said Letters Patent is hereby corrected as shown below:

Column 2,
Line 22, “to” should be -- or --;
Lines 37 and 39, “verses” should be -- versus --;

Column 3,
Line 25, (both occurrences), delete “%”;
Line 32, “alloys” should be -- alloy --;
Line 42, “$\gamma$ ' channels” should be -- $\gamma$ channels --;

Column 5,
Line 25, “or” should be -- of --;
Line 47, “(CM 186 LC)®” should be -- (CM 186 LC®) --;

Column 7,
Line 46, delete “is”;
Line 51, “alloy” should be -- alloys --;

Columns 7-8,
Line 29, “SI” should be -- Si --;
Line 32, “T1” should be -- Tl --;

Column 9,
Line 2, “respectfully” should be -- respectively --.

Signed and Sealed this

Fifteenth Day of June, 2004

JON W. DUDAS
*Acting Director of the United States Patent and Trademark Office*